US010520293B2

(12) United States Patent
Colomine et al.

(10) Patent No.: US 10,520,293 B2
(45) Date of Patent: Dec. 31, 2019

(54) TOOL FOR ATTACHING AND/OR DETACHING MEDIUM-CALIBER AMMUNITION WITHIN A LINKED CHAIN

(71) Applicant: CMI Defence S.A., Loncin (BE)

(72) Inventors: Anthony Colomine, Ixelles (BE); Innokenty Gritskevitch, Liege (BE); Domenico Farinella, Rocourt (BE)

(73) Assignee: CMI DEFENCE S.A., Loncin (BE)

( * ) Notice: Subject to any disclaimer, the term of this patent is extended or adjusted under 35 U.S.C. 154(b) by 0 days.

(21) Appl. No.: 15/774,322

(22) PCT Filed: Oct. 25, 2016

(86) PCT No.: PCT/EP2016/075615
§ 371 (c)(1),
(2) Date: May 8, 2018

(87) PCT Pub. No.: WO2017/080808
PCT Pub. Date: May 18, 2017

(65) Prior Publication Data

US 2019/0339050 A1 Nov. 7, 2019

Related U.S. Application Data

(60) Provisional application No. 62/253,367, filed on Nov. 10, 2015.

(30) Foreign Application Priority Data

Dec. 9, 2015 (BE) ..... 20155803

(51) Int. Cl.
*F42B 39/10* (2006.01)

(52) U.S. Cl.
CPC ..... *F42B 39/10* (2013.01)

(58) Field of Classification Search
CPC ..... F41A 9/83; F42B 39/10
(Continued)

(56) References Cited

U.S. PATENT DOCUMENTS 2,344,443 A * 3/1944 McCord ..... F42B 39/10 86/48
2,415,561 A * 2/1947 Jervey ..... F42B 39/10 86/48

(Continued)

FOREIGN PATENT DOCUMENTS

CH 335117 A 12/1958
EP 1691164 A1 8/2006

(Continued)

*Primary Examiner* — Joshua E Freeman
(74) *Attorney, Agent, or Firm* — Leydig, Voit & Mayer, Ltd.

(57) ABSTRACT

A system for attaching and/or detaching ammunition having the form of a linked chain or strip includes a chain of ammunition having a head, a case, and a base that are essentially cylindrical, successively attached to one another by links, each link including a first part and a second part, articulated and offset relative to one another, the second part including a loop or ansa that is central relative to a height of the link, defining an approximately semi-cylindrical opening, dimensioned to be adjusted on the case of a cartridge of a given caliber, the first part including two loops of this type but situated, in terms of height, respectively on either side of the central loop, at least the central loop including, at its free ends, a small loop oriented in a direction opposite that of a main loop, so as to define a flare.

3 Claims, 6 Drawing Sheets

(58) Field of Classification Search
USPC ..... 89/35.02; 86/48
See application file for complete search history.

(56) References Cited

U.S. PATENT DOCUMENTS

| | | | | | |
|---|---|---|---|---|---|
| 2,449,543 | A | * | 9/1948 | Baker | F42B 39/10 86/48 |
| 2,640,387 | A | * | 6/1953 | Simpson | F42B 39/10 86/48 |
| 3,002,416 | A | * | 10/1961 | Casler | F42B 39/10 86/48 |
| 3,333,506 | A | * | 8/1967 | Henshaw | F41A 9/30 89/33.25 |
| 4,790,231 | A | * | 12/1988 | Stoner | F42B 39/087 89/35.02 |
| 5,458,045 | A | * | 10/1995 | Sanderson | B64D 7/00 89/33.16 |
| 5,831,197 | A | * | 11/1998 | Bill | F42B 33/002 86/23 |

FOREIGN PATENT DOCUMENTS

| | | | |
|---|---|---|---|
| GB | 538815 | A | 8/1941 |
| SU | 117315 | A1 | 11/1957 |
| WO | WO 2013122541 | A1 | 8/2013 |

* cited by examiner

TOOL FOR ATTACHING AND/OR DETACHING MEDIUM-CALIBER AMMUNITION WITHIN A LINKED CHAIN

CROSS-REFERENCE TO PRIOR APPLICATIONS

This application is a U.S. National Phase application under 35 U.S.C. § 371 of International Application No. PCT/EP2016/075615, filed on Oct. 25, 2016, and claims benefit to U.S. Provisional Patent Application No. 62/253,367, filed on Nov. 10, 2015, and Belgian Patent Application No. 2015/5803, filed on Dec. 9, 2015. The International Application was published in French on May 18, 2017 as WO 2017/080808 under PCT Article 21(2).

FIELD

The present invention relates to the field of the manipulation of medium-caliber ammunition and in particular relates to attaching and/or detaching the latter within a flexible strip or chain, linked, of pieces of ammunition that are placed or deposited at any support, in any outside or inside environment (vehicle, turret, etc.). The invention more particularly relates to a tool making it possible to attach medium-caliber ammunition, i.e., typically comprised between 15 and 50 mm, to an ammunition strip and/or to detach it from the ammunition strip.

The invention may, however, a priori apply to all types of linked ammunition and to all devices whereof the transported elements are connected by a strip or chain made up of links having specific assembly characteristics so as to allow the insertion of the tool according to the present invention.

BACKGROUND

The ammunition strips considered in the context of the present invention are made up of cartridges clipped in a flexible strip or chain using metal connections or links. FIGS. 1 and 2 show views of such links, alone and in combination with a cartridge. The link strictly speaking 10 is made up of a first part 11 and a second part 12, generally articulated to one another. The second part 12 comprises a loop or ansa 13 that is central relative to the height of the link 10, defining an approximately semi-cylindrical opening, dimensioned to be adjusted on the case 21 of a cartridge 20 of a given caliber. The first part 11 comprises two loops 14, 15 of this type, but situated, in terms of height, respectively on either side of the central loop 13. Each of these loops 13, 14, 15 comprises, at its free ends, a small loop 16 oriented in the other direction, so as to define a flare allowing easy insertion or removal of the cartridge. The upper loop 14 of the first part 11 is extended by an essentially flat and rectangular part 17 extending upward and the lower loop 15 of the first part 11 is extended downward by an essentially flat part 18, ending with a finger 19 that is inserted into the removal groove 22 of the cartridge 20 in order to make sure that the cartridge is correctly aligned in the chain.

Furthermore, it is known that the (re)loading of a linked chain of medium or large caliber ammunition is often impossible with bare hands due to the excessive force required, or the bulk specific to a turret, for example.

Currently, this need may often be met in a relatively unorthodox manner through the use of an additional tool (hammer and chisel or screwdriver). To detach the ammunition, the percussive movement of the hammer on the chisel (or screwdriver) makes it for example possible to separate the chain at the junction of two links. It is also possible to remove the link by using the screwdriver as a lever. In the case of attaching ammunition, the penetration of the cartridge in the ansa of the free link may be obtained by a hammer blow (or a kick).

The technical problem encountered may be found outside or inside the turret:

- outside the turret, before loading the linked chain of ammunition, the latter has the form of a straight strip. To make it possible to attach and/or detach pieces of ammunition, it is often sufficient to "bend" the strip practically at 90° so as to be able to rely on the torsion capacity of the ammunition strip and on the elasticity of the metal making up the links;
- within a turret, however, in an ammunition rack placed behind the commander or the shooter, the space allotted to the ammunition is relatively restricted and therefore difficult to access. Under these conditions, to load and/or unload the ammunition strip, the use of a tool such as a hammer and chisel or screwdriver has many drawbacks (greater mechanical forces, dangerousness of the maneuver relative to a potential explosion, etc.)

Solutions exist in the state of the art to resolve this problem.

Document WO 2013/122541 A1 discloses a tool making it possible to attach and/or detach one piece of ammunition relative to another due to a vertical movement relative to one another. The tool is inserted below the two pieces of ammunition, which is why it is necessary to have a certain amount of space below the latter to insert the tool.

Document EP 1 691 164 A1 discloses a tool favoring the removal of a piece of ammunition owing to a vertical movement thereof. The tool is inserted from above and pinches the piece of ammunition at the level of the chain. The links are thus disengaged so as to be able to lift the piece of ammunition like a bottle opener.

Document GB 538 815 A discloses a tool intended to remove a piece of ammunition within an existing chain by pinching several adjacent pieces of ammunition simultaneously in order to remove the central piece of ammunition therefrom.

The tools proposed in the prior art, considered alone, do not meet the criteria set out by the Applicant (calibers of the ammunition, space allocated to insert the instrument, etc.). The main drawbacks of these various approaches are as follows:

- need to have sufficient space to insert the tool (either below or above the ammunition), which is why the operation cannot be done under all conditions (on the ground, within the ammunition rack, etc.);
- the attaching and/or detaching do not always apply;
- the calibers targeted by the present invention are not systematically accessible to the aforementioned tools.

In summary, in this instance, the technical problem encountered is threefold:

- securing the operation as much as possible to avoid a potential explosion;
- taking account of the narrow space between the apex of the ammunition and the roof of the conveyor in a turret;
- factoring in the narrowness inside the turret which does not make it possible to perform "excessively" ample movements done by the person during manipulation of the tool.

SUMMARY

In an embodiment, the present invention provides a system for attaching and/or detaching ammunition having the form of a linked chain or strip, comprising: a chain of a plurality of ammunition each having a head, a case, and a base that are essentially cylindrical, the ammunition being successively attached to one another by links, each link comprising a first part and a second part, articulated and offset relative to one another, the second part comprising a loop or ansa that is central relative to a height of the link, defining an approximately semi-cylindrical opening, dimensioned to be adjusted on the case of a cartridge of a given caliber, the first part comprising two loops of this type but situated, in terms of height, respectively on either side of the central loop, at least the central loop comprising, at its free ends, a small loop oriented in a direction opposite that of a main loop, so as to define a flare configured to allow easier insertion or removal of the cartridge, the upper loop of the first part being extended by an essentially flat and rectangular part extending upward and the lower loop of the first part being extended downward by an essentially flat part, ending with an index that is inserted into a removal groove of the ammunition; and a tool, comprising: a first arm and a second arm configured to be set in rotation in a plane independently of one another; a fixed structure configured to be placed in an upper position relative to the ammunition chain and having an oval geometric shape, the fixed structure comprising two through orifices; movable hollow cylindrical structures extending downward, arranged inside each of the respective orifices, with appropriate play, the fixed structure having an interval configured to insert and connect an arm to each of these cylindrical structures, the arm ending with a circular collar having an inner diameter the same as that of the corresponding orifice, each hollow cylindrical structure being provided on its outer edge, in a front, with a short lateral portion slightly curved to match the cylindrical shape of the case, the cylindrical structure situated on the right, seen from a front of the tool, being provided in an extension of the corresponding short portion with a finger, also slightly cylindrical and having a protuberance on its left; on a rear side, across from each orifice, covers forming respective grooves positioned along an axis of the fixed structure and each configured to match a shape of the upper flat of the first part of the adjacent links of the ammunition chain, the cover situated across from the hollow cylindrical structure having the finger being fastened to the fixed structure and the cover situated across from the other hollow cylindrical structure being secured to the latter and therefore rotatably movable; wherein, in case of attaching and/or detaching ammunition, respectively: at a location of the chain where one wishes to create a split, the tool device is configured to be simultaneously placed at an apex of two adjacent pieces of ammunition by inserting the respective heads into the orifices, the upper flats of the adjacent links being inserted into the grooves of the respective aforementioned covers to secure the first parts of the two adjacent links during rotation of the movable arms to the fixed structure and the other hollow cylindrical structure, respectively, wherein, when the movable arms are set in rotation and moved apart, brought closer to one another, respectively, the protuberance of the finger is configured to act as a lever on the ansa of the second link part surrounding the cartridge via a thrust on the small loop of that ansa situated across from the finger, to spread open the ansa at that location, the first part of the corresponding link surrounding the adjacent cartridge being configured to rotate with the adjacent cartridge owing to the other movable arm, this rotation reinforcing the spreading action of the protuberance on the small loop, and wherein the ansa of the link being spread, the adjacent cartridge is configured to be easily be removed therefrom, inserted therein, respectively.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
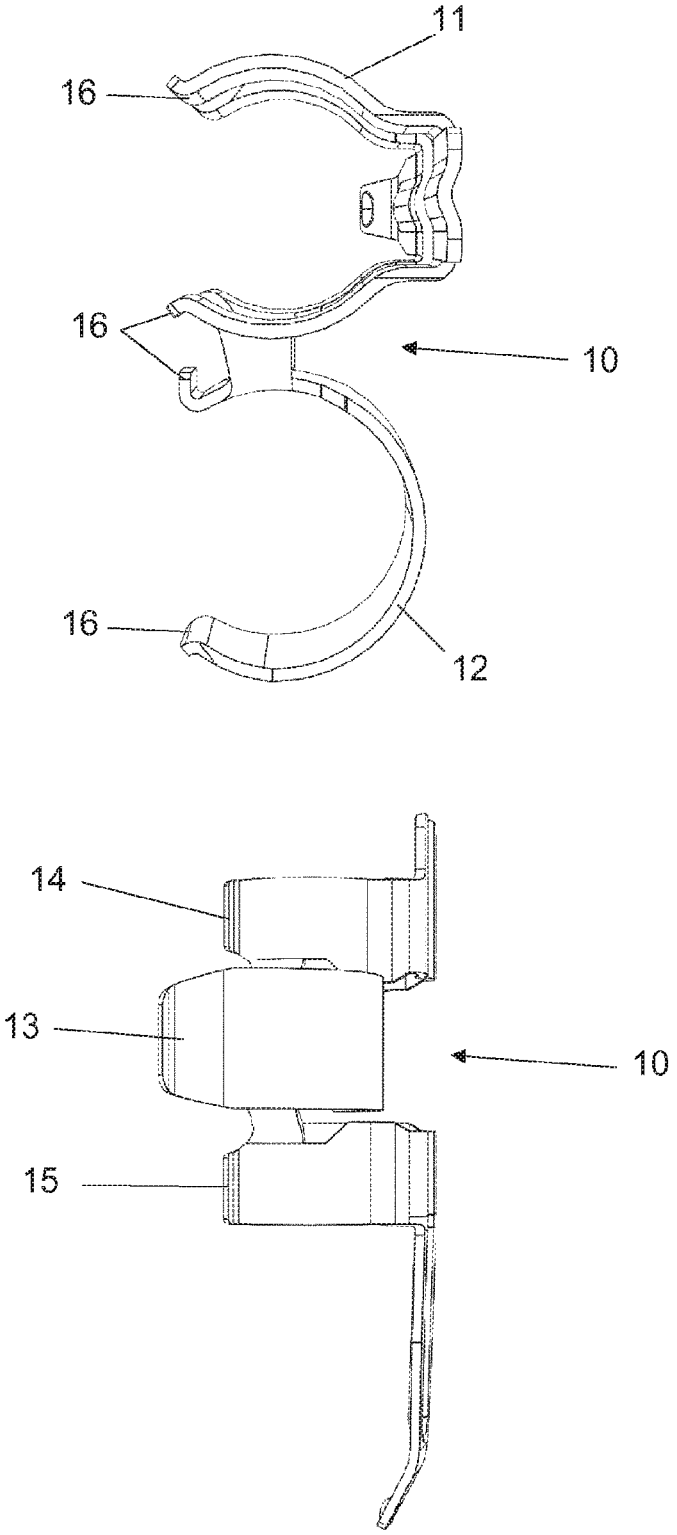
FIG. 1, already mentioned above, respectively shows a top view and an elevation view of an example of a link of a medium-caliber ammunition strip.
Figure 2:
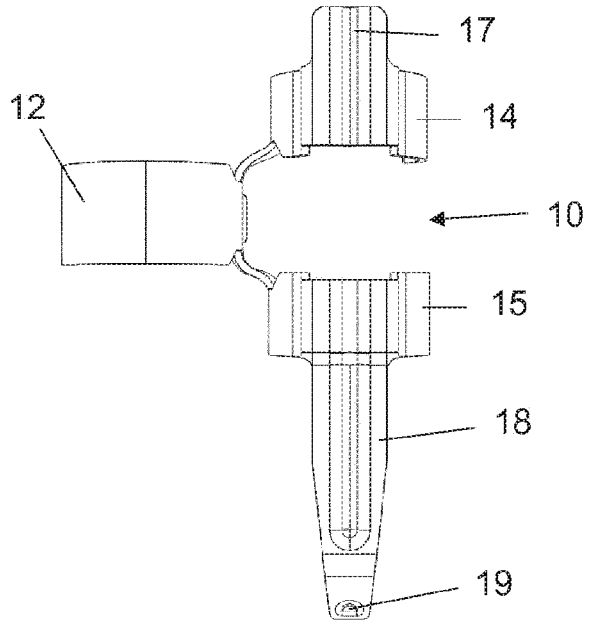
FIG. 2, already mentioned above, shows respective elevation views of the link alone and of the cartridge inserted into the link.
Figure 2:
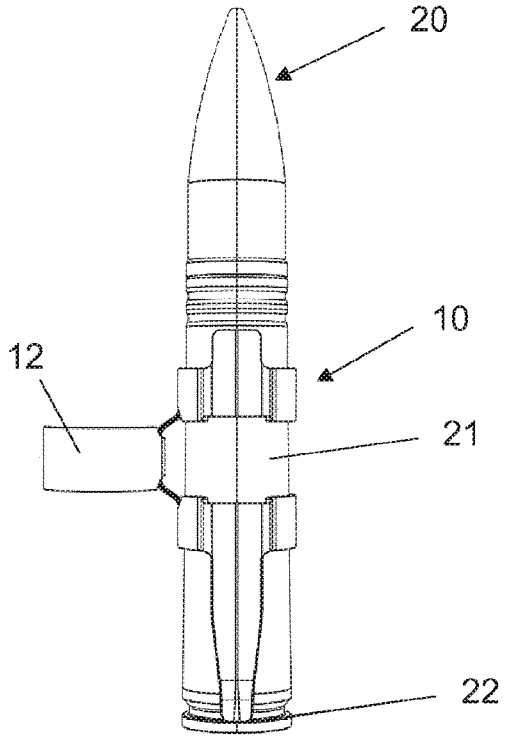

In an embodiment, the present invention provides a solution for the easy manipulation of medium-caliber ammunition.

In an embodiment, the invention allows easy and safe attaching and/or detaching of the latter within a linked chain of medium-caliber ammunition placed or deposited at any support.

In an embodiment, the present invention is also able to modify the length of the medium-caliber ammunition chain at any time (increase or decrease).

In an embodiment, the invention provides a device designed to be easily integrated into the restricted environment allocated inside a turret of a vehicle, in other words a tool of reduced size that is useful and effective.

The present invention relates to a system for attaching and/or detaching ammunition having the form of a linked chain or strip, comprising a chain of ammunition having a head, a case and a base that are essentially cylindrical, successively attached to one another by links, each link being made up of a first part and a second part, articulated and offset relative to one another, the second part comprising a loop or ansa that is central relative to the height of the link, defining an approximately semi-cylindrical opening, dimensioned to be adjusted on the case of a cartridge of a given caliber, the first part comprising two loops of this type but situated, in terms of height, respectively on either side of the central loop, at least the central loop comprising, at its free ends, a small loop oriented in the direction opposite that of the main loop, so as to define a flare allowing easier insertion or removal of the cartridge, the upper loop of the first part being extended by an essentially flat and rectangular part extending upward and the lower loop of the first part being extended downward by an essentially flat part, ending with an index that is inserted into the removal groove of the ammunition, as well as a tool made up of:

a first arm and a second arm able to be set in rotation in a plane independently of one another;

a fixed structure intended to be placed in an upper position relative to the ammunition chain, i.e., across from the heads, and having an oval geometric shape, said fixed structure comprising two through orifices;

movable hollow cylindrical structures extending downward, arranged inside each of the respective orifices, with appropriate play, the fixed structure having an interval to insert and connect an arm to each of these cylindrical structures, said arm ending with a circular collar having the same inner diameter as the corresponding orifice, each hollow cylindrical structure being provided on its outer edge, in the front, with a short lateral portion slightly curved to match the cylindrical shape of the case, the cylindrical structure situated on the right, seen from the front of the tool, being provided in the extension of the corresponding short portion with a finger that is also slightly cylindrical and having a protuberance on its left;

on one rear side, across from each orifice, covers forming respective grooves positioned along the axis of the fixed structure and each intended to match the shape of the upper flat of the first part of the adjacent links of the ammunition chain, the cover situated across from the hollow cylindrical structure having the finger being fastened to the fixed structure and the cover situated across from the other hollow cylindrical structure being secured to the latter and therefore rotatably movable;

such that, in case of attaching and/or detaching ammunition, respectively:

at the location of the chain where one wishes to create the split, the tool device can be simultaneously placed at the apex of two adjacent pieces of ammunition by inserting the respective heads into the orifices, the upper flats of the adjacent links being inserted into the grooves of the respective aforementioned covers to secure the first parts of the two adjacent links during the rotation of the movable arms to the fixed structure and to the other hollow cylindrical structure, respectively;

when the movable arms are set in rotation and moved apart, brought closer to one another, respectively, the protuberance of said finger can act as a lever on the ansa of the second link part surrounding the cartridge, more specifically via a thrust on the small loop of that ansa situated across from the finger, to spread open the ansa at that location, the first part of the corresponding link surrounding the adjacent cartridge rotating with the adjacent cartridge owing to the other movable arm, this rotation reinforcing the spreading action of the protuberance on the small loop;

the ansa of the link being spread, the adjacent cartridge can easily be removed therefrom, inserted therein, respectively.

Advantageously, the orifice corresponding to the first movable arm is a circular hole, while the orifice corresponding to the second movable arm is an oblong hole.

Also advantageously, the interval provided in the oval structure to insert and connect an arm has an extension of the opening at the outer rounded sides of the oval so as to allow right or left use of the tool, indifferently and reversibly, relative to the orientation of the links of the ammunition chain.

The effect sought by the present invention is to facilitate the attaching and/or detaching of medium-caliber ammunition at a linked medium-caliber ammunition chain of any length so as to:

reduce the "physical" forces and mechanical stresses compared to those encountered during the use of the tools of the prior art (in particular hammer and chisel or screwdriver);

use a single tool that is very easy to manipulate for both operations;

avoid needless and potentially dangerous impacts caused by certain tools of the prior art (in particular hammer and chisel or screwdriver);

decrease the costs of the operation.

The tool according to the invention will make it possible to:

be more efficient and precise, mechanically speaking, by implementing a single movement when attaching and/or detaching medium-caliber ammunition (no translational, rotational, torsional, etc. movement of one piece of ammunition relative to the other);

practically eliminate the risks related to the occurrence of damage, whether minor or major, at one (or several) piece(s) of medium-caliber ammunition, or to an explosion at one (or several) piece(s) of ammunition caused by a "blow" from a chisel or screwdriver, for example, and decrease the damage caused to the links strictly speaking, given that the tool does not rely on the elasticity of the steel thereof.

Figure 3:
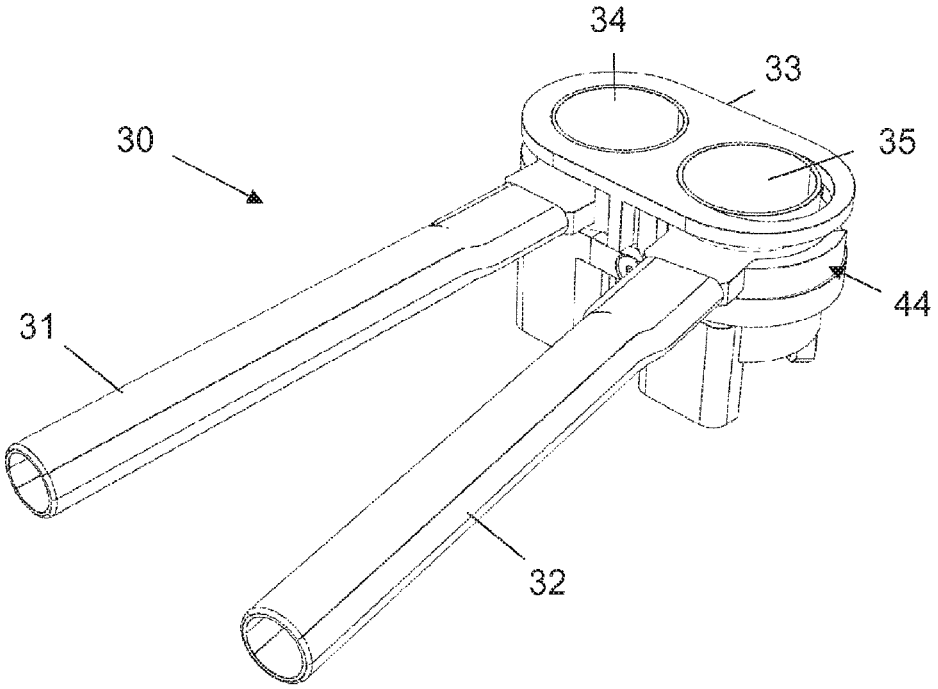
FIG. 3 shows two rear perspective views of one embodiment of the tool according to the present invention.
Figure 3:
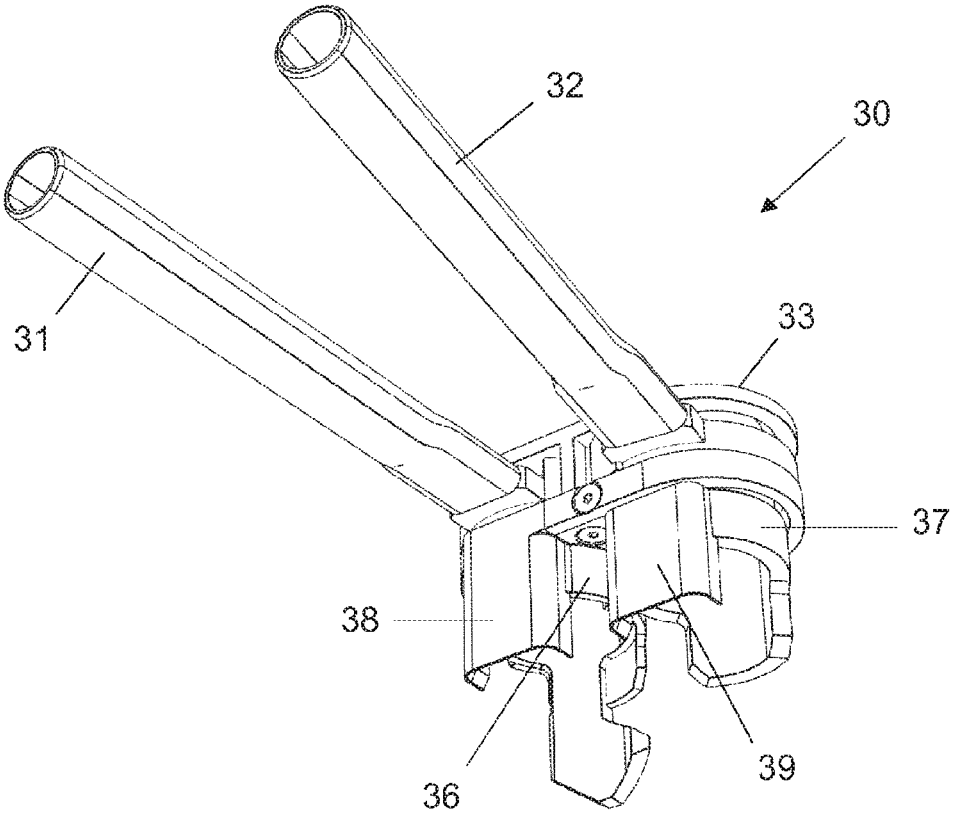
Figure 4:
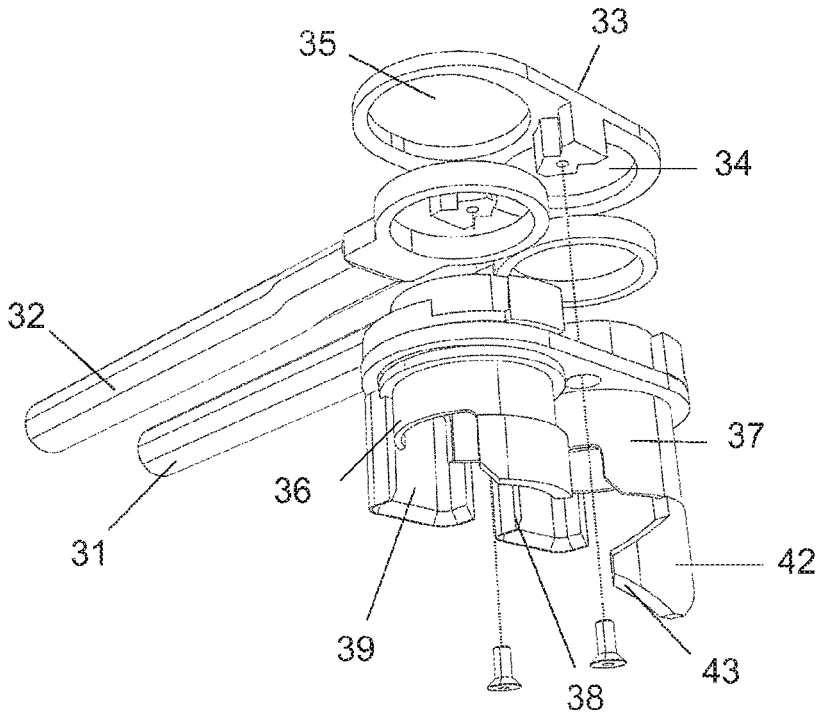
FIG. 4 shows two front perspective views of one embodiment of the tool according to the present invention.
Figure 4:
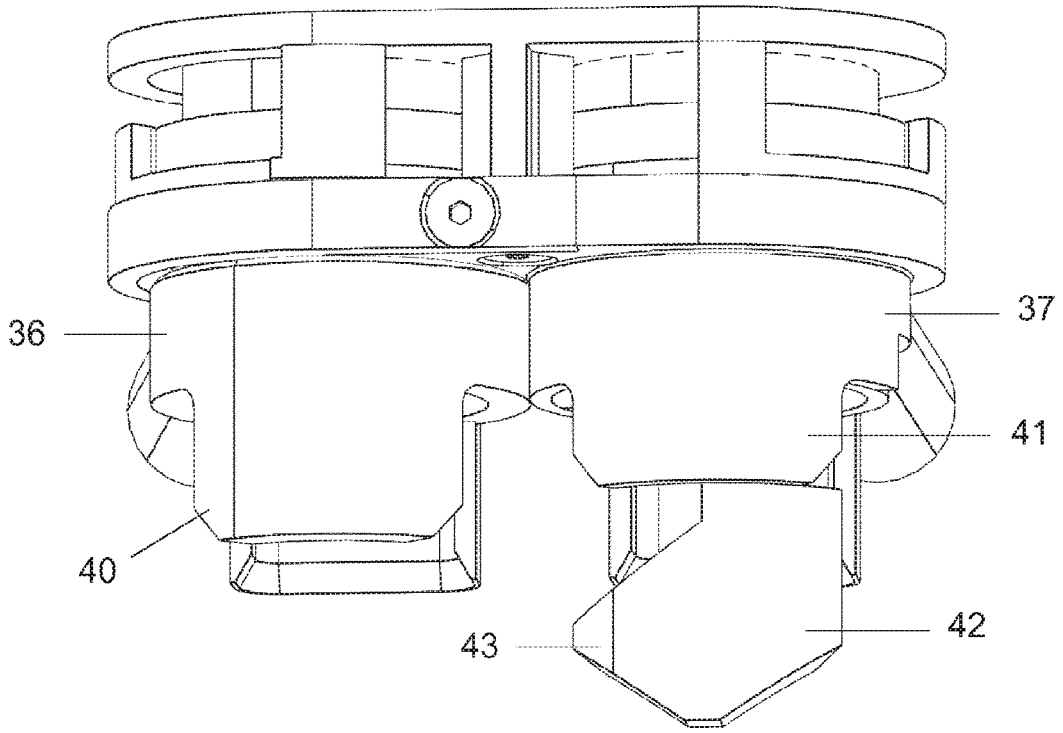

In reference to FIGS. 3 and 4, the tool 30 according to one preferred embodiment of the invention comprises two arms 31, 32, for example initially parallel, but at least one of which, preferably both, can be set in rotation in a plane completely independently of one another. The two arms 31, 32 are inserted in a fixed (non-rotating) structure 33 intended to be placed in an upper position relative to the medium-caliber ammunition chain (i.e., across from the bullets or heads) and having an oval geometric shape. For clarity reasons, the tool will be described with the arms arranged horizontally, but during use, the angular position of the arms can be other than horizontal (for example, when the ammunition chain is lying on the ground).

The upper structure 33 comprises two circular through orifices 34, 35, i.e., passing through it from top to bottom. Inside each of these orifices, a respective hollow vertical cylindrical structure 36, 37 is arranged, optionally with appropriate play, extending vertically and downward. The arms 31, 32 are secured to the respective cylindrical structures 36, 37. For example, the arms 31, 32 are attached to—or inserted in—the structures 36, 37, and a rotational movement of at least one of these structures is allowed by actuating the arms. Furthermore, the arms end with a circular collar having the same inner diameter as the orifices of the oval structure 33. They are inserted in an interval 44 provided in the oval structure 33, this interval 44 being designed to allow a rotation and right or left use (relative to the orientation of the links), indifferently and reversibly, owing to the extension of the opening at the outer rounded sides of the structure 33.

The back of each of the respective structures 36, 37 comprises a cover having a groove 38, 39 positioned along the axis of the cylindrical structure and intended to match the shape of the upper flat 17 of the first part 11 of the links 10 of the medium-caliber ammunition chain. The cover 38 is secured to the structure 33 therefore fixed, while the cover 39 is secured to the movable structure 37, therefore with the rotatably movable arm 32.

In the front, the structures 36, 37 are each provided on their outer edge with a short lateral portion 40, 41 slightly curved to match the cylindrical shape of the case. Still seen from the front of the tool, the cylindrical structure 37 situated on the right is provided in the extension of the corresponding short portion 41 with a finger 42, also slightly cylindrical, having a protuberance 43 on its left.

Figure 5:
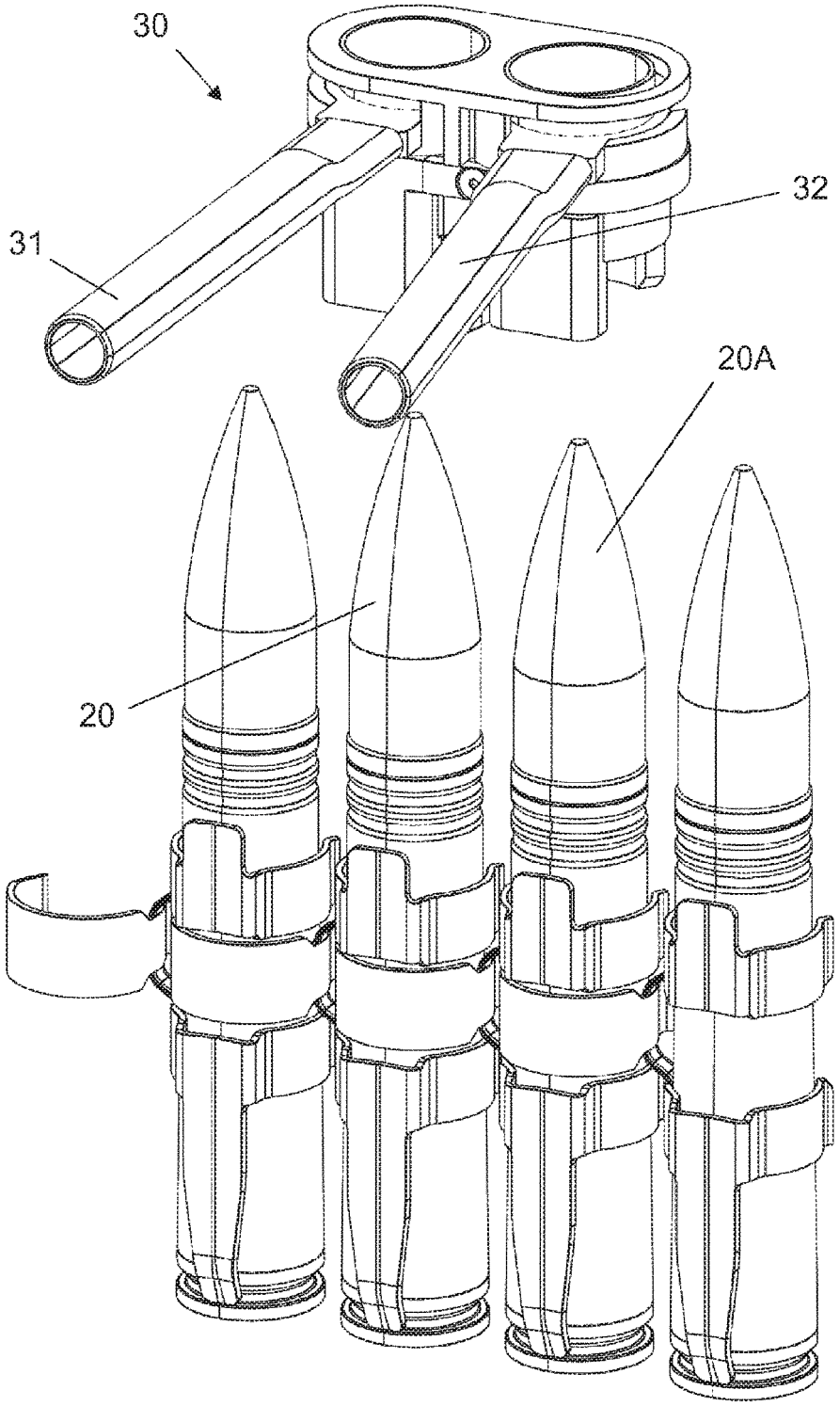
FIG. 5 shows the aforementioned tool relative to a medium-caliber ammunition chain.

During use, two scenarios may occur. The tool according to the invention is shown relative to the medium-caliber ammunition chain, as indicated in FIG. 5.

Figure 6:
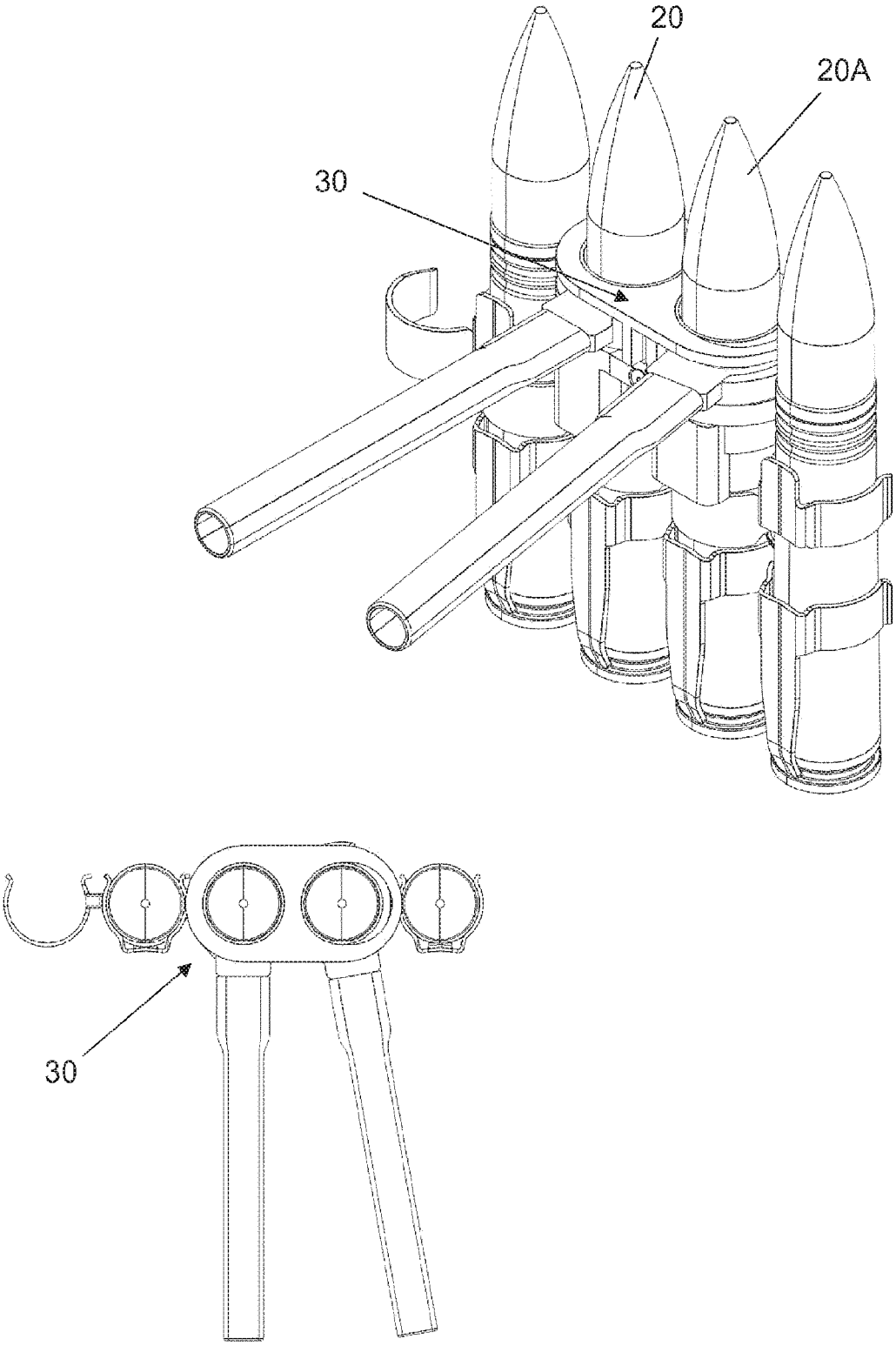
FIG. 6 shows the aforementioned tool in position to split the medium-caliber ammunition chain.

In case of detaching medium-caliber ammunition, one places, as shown in FIG. 6, at the location of the chain where one wishes to create the split, the tool device at the apex of two adjacent pieces of ammunition 20, 20A by inserting the respective heads into the orifices 34, 35, the upper flats 17 of the concerned links being inserted into the respective grooves 38, 39 of the aforementioned covers. The first parts 11 of the two adjacent links (or the corresponding cartridges) will then be respectively kept fixed and movable if the arms rotate, which will allow a relative movement of the adjacent cartridges.

According to one preferred embodiment of the invention for detaching medium-caliber ammunition, the left arm 31 and the right arm 32 (seen from the rear of the device) are moved apart from the parallel initial position of the arms. The finger 42, which rotates with the arm 31 toward the inside owing to its protuberance 43, will act as a lever on the central ansa 13 of the second link part gripping the cartridge 20 and that one wishes to detach precisely, and more specifically via a thrust on the small loop 16 of this link, which will spread open the central ansa 13 at this location. By rotating counterclockwise, the left arm 32 will again accentuate the opening of the ansa 13 and reinforce the spreading of the loop 16, the adjacent cartridge 20A and the first link part being driven in rotation with the arm 32, which blocks the upper flat 17 of the link in the groove 39. An additional force is exerted via the hinge between the first and second link parts.

In case of attaching medium-caliber ammunition, the principle is the same, but with a rotation of the arms in the opposite direction (bringing closer to each other), considering that it will be necessary to push the piece of ammunition slightly into the ansa spread open by the tool to secure the two parts of the chain.

The movement/mechanical stress relative to the attaching and/or detaching of the ammunition is moreover insignificant following the extremely easy rotation of the two arms. The invention is characterized by the possibility of attaching and/or detaching medium-caliber ammunition in a single movement using a single device by causing a limited transverse movement of the pieces of ammunition at their links. It is no longer necessary to twist the chain to cause the ansa of the link to become larger, or to rely on the elasticity of the metal of the links.

The orifice 35 situated in the separating part is an oblong hole (wider by several mm than the through hole 34). The function of the latter is to take into account the geometry of the link connected to the ammunition during opening. Indeed, since this geometry is not exactly that of a half-circle, this requires providing a slight spatial shift when one piece of ammunition is attached on the next one.

In the case of supplying a turret cannon of a vehicle with an ammunition chain, the reduced thickness of the tool makes it entirely possible to insert or position the latter quite easily between the apex of the ammunition and the roof of the conveyor.

The present invention has the following advantages:

- very light and easy-to-handle device;
- decreased mechanical stress during rotation of the arms;
- fairly reduced, or even negligible, thickness of the device, which allows it to be used with or without a solid structure above the medium-caliber ammunition;
- possibility of attaching and/or detaching a piece of ammunition with a single device;
- favorable attaching and/or detaching of the ammunition considering this operation from the horizontal position (angle relative to the ground=0°) to the vertical position of the ammunition (angle relative to the ground=90°—for the latter, the ammunition must rest on the rear base and not on the tip);
- no risk of explosion of a piece of ammunition during or after manipulation;
- attaching and/or detaching of the ammunition considering the links situated in front of the user ("inner" side of the ammunition chain) and/or located on the opposite side to the latter ("outer" side of said chain).

It has the drawback of a slight shift when the piece of ammunition is attached on the next one, which requires the orifice 35 to be oblong and therefore not spherical.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. A system for attaching and/or detaching ammunition having the form of a linked chain or strip, comprising:

a chain of a plurality of ammunition each having a head, a case, and a base that are essentially cylindrical, the ammunition being successively attached to one another by links, each link comprising a first part and a second part, articulated and offset relative to one another, the second part comprising a loop or ansa that is central relative to a height of the link, defining an approximately semi-cylindrical opening, dimensioned to be adjusted on the case of a cartridge of a given caliber, the first part comprising two loops of this type but situated, in terms of height, respectively on either side of the central loop, at least the central loop comprising, at its free ends, a small loop oriented in a direction opposite that of a main loop, so as to define a flare configured to allow easier insertion or removal of the cartridge, the upper loop of the first part being extended by an essentially flat and rectangular part extending upward and the lower loop of the first part being extended downward by an essentially flat part, ending with an index that is inserted into a removal groove of the ammunition; and a tool, comprising:

a first arm and a second arm configured to be set in rotation in a plane independently of one another;

a fixed structure configured to be placed in an upper position relative to the ammunition chain, i.e., across from the heads and having an oval geometric shape, the fixed structure comprising two through orifices;

movable hollow cylindrical structures extending downward, arranged inside each of the respective orifices, with appropriate play, the fixed structure having an interval configured to insert and connect an arm to each of these cylindrical structures, the arm ending with a circular collar having an inner diameter the same as that of the corresponding orifice, each hollow cylindrical structure being provided on its outer edge, in a front, with a short lateral portion slightly curved to match the cylindrical shape of the case, the cylindrical structure situated on the right, seen from a front of the tool, being provided in an extension of the corresponding short portion with a finger, also slightly cylindrical and having a protuberance on its left;

on a rear side, across from each orifice, covers forming respective grooves positioned along an axis of the fixed structure and each configured to match a shape of the upper flat of the first part of the adjacent links of the ammunition chain, the cover situated across from the hollow cylindrical structure having the finger being fastened to the fixed structure and the cover situated across from the other hollow cylindrical structure being secured to the latter and therefore rotatably movable;

wherein, in case of attaching and/or detaching ammunition, respectively:

at a location of the chain where one wishes to create a split, the tool device is configured to be simultaneously placed at an apex of two adjacent pieces of ammunition by inserting the respective heads into the orifices, the upper flats of the adjacent links being inserted into the grooves of the respective aforementioned covers to secure the first parts of the two adjacent links during rotation of the movable arms to the fixed structure and the other hollow cylindrical structure, respectively, wherein, when the movable arms are set in rotation and moved apart, brought closer to one another, respectively, the protuberance of the finger is configured to act as a lever on the ansa of the second link part surrounding the cartridge via a thrust on the small loop of that ansa situated across from the finger, to spread open the ansa at that location, the first part of the corresponding link surrounding the adjacent cartridge being configured to rotate with the adjacent cartridge owing to the other movable arm, this rotation reinforcing the spreading action of the protuberance on the small loop, and wherein the ansa of the link being spread, the adjacent cartridge is configured to be easily be removed therefrom, inserted therein, respectively.

2. The system for attaching and/or detaching ammunition according to claim 1, wherein the orifice corresponding to the first movable arm comprises a circular hole, while the orifice corresponding to the second movable arm comprises is an oblong hole.

3. The system for attaching and/or detaching ammunition according to claim 1, wherein the interval provided in the oval structure configured to insert and connect an arm has an extension of the opening at outer rounded sides of the oval so as to allow right or left use of the tool, indifferently and reversibly, relative to an orientation of the links of the ammunition chain.

* * * * *